US005770035A

United States Patent [19]

Faita

[11] Patent Number: 5,770,035

[45] Date of Patent: Jun. 23, 1998

[54] METHOD FOR THE ELECTROLYSIS OF AQUEOUS SOLUTIONS OF HYDROCHLORIC ACID

[75] Inventor: Giuseppe Faita, Novara, Italy

[73] Assignee: De Nora S.p.A., Italy

[21] Appl. No.: 769,483

[22] Filed: Dec. 18, 1996

[30] Foreign Application Priority Data

Jan. 19, 1996 [IT] Italy ..... MI96A0086

[51] Int. Cl.[6] ..... C25B 1/26

[52] U.S. Cl. ..... 205/624; 205/620; 205/622

[58] Field of Search ..... 204/252, 263, 204/265, 266; 205/618, 620, 621, 622, 624

[56] References Cited

U.S. PATENT DOCUMENTS

| | | | |
|---|---|---|---|
| 2,468,766 | 5/1949 | Low | 205/622 |
| 3,711,385 | 1/1973 | Beer | 205/464 |
| 4,191,618 | 3/1980 | Coker et al. | 205/525 |

FOREIGN PATENT DOCUMENTS 57-194284 11/1982 Japan .

OTHER PUBLICATIONS

Japio Abstract of Asahi Glass Co (JP 57194284), Nov. 29, 1982.

Caplus Abstract of Asahi Glass Co (JP 57194284), Nov. 29, 1982.

*Primary Examiner*—T. Tung
*Assistant Examiner*—Alex Noguerola
*Attorney, Agent, or Firm*—Bierman, Muserlian and Lucas

[57] ABSTRACT

The improved method for the production of chlorine from aqueous solutions of hydrochloric acid in a membrane electrolysis cell comprises a cathode compartment equipped with a gas diffusion cathode fed with air or enriched air or oxygen and an anodic compartment with an anode provided with an electrocatalytic coating for chlorine evolution. Said anode compartment is fed with an aqueous solution of hydrochloric acid having a maximum concentration of 20% and a maximum temperature of 60° C., and containing an oxidizing compound having a redox potential of at least 0 Volts NHE and preferably 0.3–0.6 Volts NHE. A suitable oxidizing compound is trivalent iron in concentrations comprised in the range of 100–10,000 ppm. Both the anodic and cathodic compartment of the cell and their internal structures are made of titanium or alloys thereof, such as 0.2%. titanium-palladium. The parts made of titanium in which crevices may be present are provided with a protective coating based on metals of the platinum group, their oxides as such or as a mixture of the same.

21 Claims, 2 Drawing Sheets

METHOD FOR THE ELECTROLYSIS OF AQUEOUS SOLUTIONS OF HYDROCHLORIC ACID

BACKGROUND OF THE INVENTION

Modem industrial chemistry is to a large extent based on the use of chlorine as raw material. The reactions of practical interest may be divided in two families, depending whether the final product contains chlorine or does not chlorine, according to the following scheme:

A. Final products containing chlorine

A1. Production of polyvinylchloride (PVC) from polymerization of vinyl chloride monomer (VCM). VCM is obtained through the two steps of synthesis of dichloroethane (DCE) from ethylene and chlorine and from thermal. cracking of the DCE to vinyl chloride, with the following reactions:

$$CH_2{=}CH_2+Cl_2 \rightarrow CH_2Cl{-}CH_2Cl \text{ (DCE)}$$

$$CH_2Cl{-}CH_2Cl \rightarrow CHCl{=}CH_2 \text{(VCM)}+HCl$$

The hydrochloric acid which is the by-product of the reaction and corresponds to 50% of the used chlorine is further converted to additional DCE through the following reaction of oxychlorination with oxygen:

$$CH_2{=}CH_2+2HCl+\tfrac{1}{2}O_2 \rightarrow CH_2Cl{-}CH_2Cl+H_2O$$

Conversely, in other industrial processes, the hydrochloric acid cannot be recycled and poses a problem for its commercialization in a generally weak market, also in view of its content of chlorinated organic impurities.

Typical processes are listed here below.

A2. Production of chlorobenzene $$C_6H_6+Cl_2 \rightarrow C_6H_5Cl \text{ (monochlorobenzene)}+HCl$$

$$C_6H_6+2Cl_2 \rightarrow C_6H_4Cl_2 \text{ (dichlorobenzene)}+2HCl$$

A3. Production of chloromethanes $$CH_4+Cl_2 \rightarrow CH_3Cl \text{ (methylchloride)}+HCl$$

$$CH_4+2Cl_2 \rightarrow CH_2Cl_2 \text{ (methylenechloride)}+2HCl$$

The chloromethanes may be the starting materials for the production of fluorinated compounds by the exchange with hydrofluoric acid, as follows:

$$CH_3Cl+HF \rightarrow CH_3F+HCl$$

B. Final products non containing chlorine

Typical is the production of polyurethane, the starting reactants of which are isocyanates, which are obtained through two steps as follows:

$$CO+Cl_2 \rightarrow COCl_2 \text{ (phosgene)}$$

$$COCl_2+R{-}NH_2 \text{ (amine)} \rightarrow RNCO \text{ (isocyanate)}+2HCl$$

While in the chlorination process of point A) the hydrochloric acid contains 50% of the used chlorine, for the production of isocyanates all the chlorine is discharged as by-product hydrochloric acid. The same applies to the production of polycarbonates. Similar characteristics are found in the production of titanium dioxide. Chlorine is used to obtain titanium tetrachloride which is then converted into titanium dioxide with the by-production of hydrochloric acid.

As the evolution of industrial chemistry will bring shortly to the construction of new plants or the expansion of existing ones for the production of isocyanastes and fluorinated compounds besides certain chlorinated compounds, it may be easily foreseen that a greatly increased amount of hydrochloric acid will be available while the market demand will be extremely weak. With this situation the processes capable of converting hydrochloric acid into chlorine appear extremely interesting.

The technological background as regards the conversion of hydrochloric acid to chlorine may be summarized as follows:

Catalytic processes

These processes derive from the well known Deacon process, invented at the end of the nineteen century. It is based on the reaction of oxidation of gaseous hydrochloric acid on a solid catalyst (copper chloride):

$$2HCl+\tfrac{1}{2}O_2 \rightarrow Cl_2+H_2O$$

The process has recently been remarkably improved with the optimization of a catalyst containing chromium oxide and operating at relatively low temperatures. The problem affecting this process lies in the thermodynamic of the reaction, which only allows the partial conversion of hydrochloric acid. Consequently, downstream the reaction, the process must foresee both the separation of the chlorine from the hydrochloric acid and recycling of the unconverted hydrochloric acid. In addition, the aqueous phases discharged by the plant (water is a reaction product) contain heavy metals released from the catalyst. To overcome these drawbacks, it has been recently proposed to carry out the oxidation in two steps, that is: reaction between gaseous hydrochloric acid and copper oxide to form copper chloride and subsequent reaction between copper chloride and oxygen to form chlorine and copper oxide, which is anew subjected to the first reaction (Chemical Engineering News, Sep. 11, 1995). However, this new process involves the need to optimize new catalysts capable of undergoing thermal shocks and abrasion.

Electrochemical processes

The hydrochloric acid, in the form of an aqueous solution, is electrolyzed in an electrochemical cell divided in two compartments by a porous diaphragm or by an ion exchange membrane of the perfluorinated type. The following reactions take place at the two electrodes, positive (anode) and negative (cathode):

$$+)\ 2Cl{-}2e^- \rightarrow Cl_2$$

$$-)\ 2H^+{+}2e^- \rightarrow H_2$$

$$\text{Overall reaction: } 2HCl \rightarrow Cl_2{,}H_2$$

The process has been applied to a certain number of industrial plants. In its optimized version this process involves an energy consumption of 1500 kWh/ton of chlorine with a current density of 4,000 Ampere/$m^2$. This energy consumption is usually considered too high to be economically interesting also in view of the high investment costs. In fact, the strong aggressivity of both hydrochloric acid solution and chlorine leads to select graphite as the construction material, which imposes high costs for the mechanical machining. Further, the extreme brittleness of graphite involves problems of reliability of the plant and, in particular, excludes operation under pressure, which could offer remarkable advantages in terms of quality of the products and integration of the electrolysis process with the production plants. Graphite may be substituted today by graphite composites obtained through hot pressing of graphite powders and a chemically resistant thermoplastic binder, as described in U.S. Pat. No. 4,511,442. These composites require special molds and very powerful presses and further the production rate is very low. For these reasons the cost of these composites is high, thus counterbalancing their advantages of greater resistance and workability than pure graphite. It has been proposed to replace the hydrogen evolving cathode with a cathode consuming oxygen. This offers the advantage of a lower cell voltage, corresponding to a reduction of the electric energy consumption down to 1,000–1100 kWh/ton of chlorine. This reduced consumption would finally make the electrolysis processes appealing. However, this system has been tested on a lab scale and application on industrial scale was never reported. A further proposal was recently made. In the PCT publication no. W095/44797 of Du Pont De Nemours and Co. it is in fact described the electrolysis of gaseous hydrochloric acid, obtained from plants for the production of isocyanates or fluorinated or chlorinated compounds. After suitable filtration to remove the organics and solid particles which could be present, the hydrochloric acid is fed to an electrolysis cell divided in two compartments by a perfluorinated ion exchange membrane. The anode compartment comprises a gas diffusion electrode made of a porous film containing a suitable catalyst in intimate contact with the membrane. The gaseous hydrochloric acid diffuses through the electrode pores to the membrane-catalyst interface where it is converted into chlorine. The cathode compartment is provided with an electrode also in intimate contact with the membrane and capable of generating hydrogen. A water flow removes the produced hydrogen in the form of bubbles and contributes to controlling the temperature of the cell. However, under certain operating conditions and in particular during shut-down and start-up, in the anode compartment aqueous phases are produced which contain hydrochloric acid at high concentrations, indicatively 30–40%. Therefore also this process requires highly resistant materials and only graphite seems to be suitable, thus involving high investment costs, as discussed before.

OBJECTS OF THE INVENTION

It is an object of the present invention to overcome the prior art drawbacks, in particular by disclosing a new process for the electrolysis of aqueous solutions of hydrochloric acid with a cell comprising the use of an oxygen-fed gas diffusion cathode and characterized by a high mechanical reliability and reduced investment costs.

DETAILED DESCRIPTION OF THE INVENTION

Figure 1:
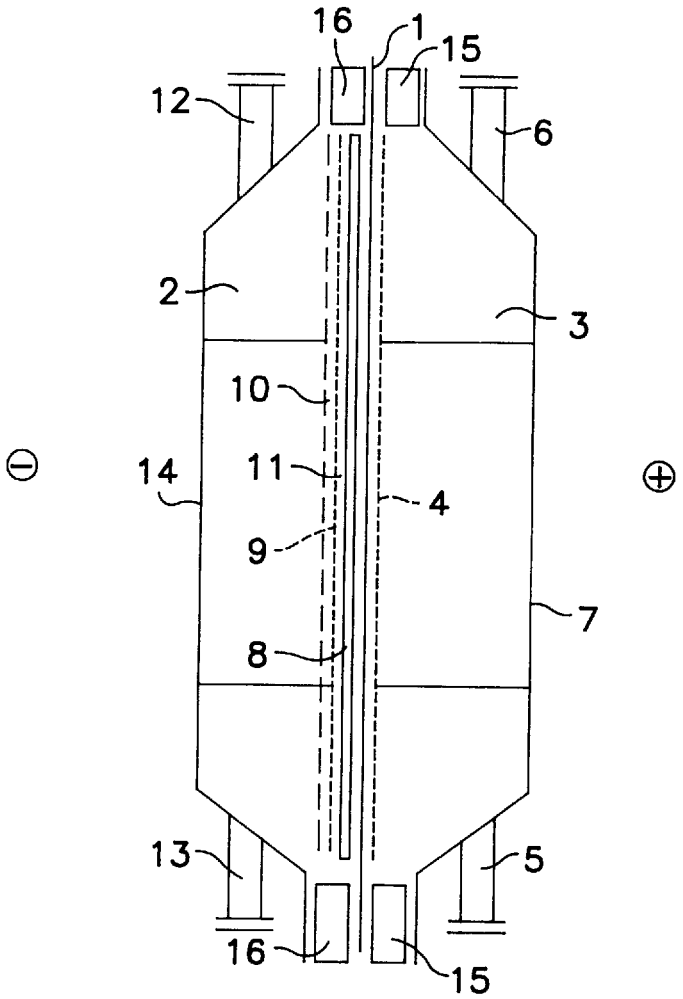
FIG. 1 is a simplified longitudinal cross-section of the electrochemical cell of the invention.

The present invention concerns a method of electrolysis of aqueous solutions of hydrochloric acid wherein an aqueous solution of hydrochloric acid is fed to the anode compartment of an electrochemical cell containing an anode made of a corrosion-resistant substrate provided with an electrocatalytic coating for chlorine evolution. Suitable substrates are porous laminates of graphitized carbon, such as for example PWB-3 Zoltec or TGH Toray, porous laminates, meshes or expanded metals made of titanium, titanium alloys, niobium or tantalum. The electrocatalytic coating may be made of oxides of the platinum group metals as such or in admixture, with the optional addition of stabilizing oxides, such as titanium or tantalum oxides. The cathode compartment is separated from the anode compartment by a perfluorinated ion exchange membrane of the cationic type. Suitable membranes are commercialized by Du Pont under the trade-mark Nafion®, in particular Nafion 115 and Nafion 117 membranes. Similar products which may also be used are commercialized by Asahi Glass Co. and Asahi Chemical Co. of Japan. The cathode compartment comprises a gas diffusion cathode fed with air, oxygen-enriched air or pure oxygen. The gas diffusion cathode is made of an inert porous substrate comprising at least on one face a porous electrocatalytic coating. The cathode is made hydrophobic, for example by embedding polytetraethylene particles in the catalytic layer and optionally also inside the whole porous substrate, in order to facilitate the release of water formed by the reaction between oxygen and the protons migrating through the membrane from the anode compartment. The substrate is generally made of a porous laminate or a graphitized carbon cloth, for example TGH Toray or PWB-3 Zoltec. The electrocatalytic layer comprises as a catalyst metals of the platinum group or oxides thereof, either per se or in admixture. The selection of the best composition takes into account the need to have at the same time favourable kinetics for the oxygen reaction and a good resistance to both the acidic conditions prevailing inside the electrocatalytic coating due to the diffusion of hydrochloric acid through the membrane from the anode compartment, as well as the high potential typical of the oxygen gas. Suitable catalysts are platinum, iridium, ruthenium oxide, per se or optionally supported on carbon powder having a high specific surface, such as Vulcan XC-72. The gas diffusion cathode may be provided with a film of a ionomeric material on the side facing the membrane. The ionomeric material preferably has a composition similar to that of the material forming the ion exchange membrane. The gas diffusion cathode is kept in intimate contact with the ion exchange membrane for example by pressing the cathode to the membrane under controlled temperature, pressure, for a suitable time, before positioning inside the cell. Preferably, in view of the lower costs, the cathode and the membrane are installed inside the cell as single pieces and kept in contact by a suitable pressure differential between the anode and cathode compartments (pressure of anode compartment higher than that of the cathode compartment). It has been found that satisfactory results are obtained with pressure differentials of 0.1–1 bar. With lower values the performances decay substantially, whereas higher values may be used even if with marginal advantages. The pressure differential is anyway useful also when the cathode is previously pressed onto the membrane, as taught in the first alternative, as detachments between the cathode and the membrane may occur with time due to the capillary pressure developed inside the pores by the water produced by the oxygen reaction. In this case the pressure differential guarantees a suitable intimate contact between the cathode and the membrane also in the detachment areas. The pressure differential may be applied only when the cathode compartment is provided with a rigid structure suitable for supporting uniformly the membrane-cathode assembly. This structure is made for example of a porous laminate of suitable thickness and good planarity. In a preferred embodiment of the present invention, the porous laminate is made of a first layer made of a mesh or expanded metal sheet having a large mesh size and the necessary thickness in order to provide for the necessary rigidity, and a second layer made of a mesh or an expanded metal sheet having a lower thickness and mesh size than the first layer, suitable for providing a high number of contact points with the gas diffusion electrode. In this way it is possible to solve easily and cheaply the problem of the contrasting requirements of the cathodic structure, that is rigidity, which means a substantial thickness, and high number of contact points, which means small pores or mesh size, easy access to oxygen and quick removal of the water formed by the reaction of oxygen, which targets can be only obtained with small thickness.

The anodic and cathodic compartments of the electrochemical cell are delimited on one side by the ion exchange membrane and on the other side by an electrically conductive wall having suitable chemical resistance. This characteristic is obvious for the anode compartment fed with hydrochloric acid but it is also necessary for the cathodic compartment. In fact, it has been noted that with the aforementioned perfluorinated membranes the water formed by the oxygen reaction, that is the liquid phase collected on the bottom of the cathodic compartment, contains hydrochloric acid in quantities ranging from 5 to 7% by weight.

The invention will be now described making reference to FIG. 1, which is a simplified longitudinal cross-section of the electrochemical cell of the invention. The cell comprises an ion exchange membrane 1, cathodic and anodic compartments 2 and 3 respectively, anode 4, acid feeding nozzle 5, nozzle 6 for the withdrawal of the exhaust acid and produced chlorine, wall 7 delimiting the anode compartment, gas diffusion cathode 8, a cathode supporting element 9 comprising a thick expanded metal sheet or mesh 10 and a thin expanded metal sheet or mesh 11, nozzle 12 for feeding air or oxygen-enriched air or pure oxygen, nozzle 13 for the withdrawal of the acidic water of the oxygen reaction and the possible excess oxygen, a cathode compartment delimiting wall 14, and peripheral gaskets 15 and 16.

In industrial practice electrochemical cells, as the one schematized in FIG. 1, are commonly assembled in a certain number according to a construction scheme, the so called "filter-press" arrangement, to form an electrolyzer, which is the electrochemical equivalent of the chemical reactor. In an electrolyzer the various cells are electrically connected either in parallel or in series. In the parallel arrangement the cathode of each cell is connected to a bus bar in electrical contact with the negative pole of a rectifier, while each anode is likewise connected to a bus bar in electrical contact with the positive pole of the rectifier. With the arrangement in series conversely, the anode of each cell is connected to the cathode of the subsequent cell, without any need for electric bus bars as for the parallel arrangement. This electrical connection may be made resorting to suitable connectors which provide for the necessary electrical continuity between the anode of one cell and the cathode of the adjacent one. When the anode and cathode materials are the same, the connection may be simply made using a single wall performing the function of delimiting both the anode compartment of one cell and the cathode compartment of the adjacent cell. This particularly simplified construction solution is used in electrolyzers using the current technology for the electrolysis of aqueous solutions of hydrochloric acid. In said technology in fact graphite is used as the only construction material both for the anode compartments and for the cathode compartments. This material however is very expensive due to the difficult and time-consuming machining, besides being scarcely reliable due to its intrinsic brittleness.

As already said, pure graphite may be replaced by composites made of graphite and polymers, especially fluorinated polymers, which are less brittle but even more expensive than pure graphite. No other material is used in the prior art. Particularly interesting would be the use of titanium, which is characterized by an acceptable cost, may be produced in thin sheets, is easily fabricated and welded and it is also resistant to the aqueous solutions of hydrochloric acid containing chlorine, which is the typical anodic environment under operation. However, titanium is easily attacked in the absence of chlorine and electric current, typical situation at the initial phase of start-up and in all those cases where anomalous sudden interruption of the electric current occurs. Further, with the prior art technology, electrolysis is carried out without gas diffusion cathodes fed with air or oxygen. Therefore, the cathodic reaction is hydrogen evolution and in the presence of hydrogen titanium, when used as the material for the cathode compartment, undergoes embrittlement.

It has been surprisingly found that by introducing certain modifications to the electrolysis process of the prior art it is possible to use titanium and alloys thereof, such as titanium-palladium (0.2%), as the construction material both for the anodic and the cathodic compartments, thus providing for a simplified and cheap construction of electrolyzers completely made of metal.

The modifications disclosed by the present invention are listed here below:

- addition of an oxidizing compound to the aqueous hydrochloric acid solution. Said compound must be always kept in the oxidized condition by chlorine and must not be significantly reduced when it comes in contact with the gas diffusion cathode. These requirements are met when the redox potential of the oxidizing compound is higher than the hydrogen discharge potential, which may occur at the gas diffusion electrode in conditions of strong anomaly. This limit value of the potential in the acidic liquid present in the pores of the gas diffusion cathode is 0 Volt of the NHE scale (Normal Hydrogen Electrode). Acceptable values for the redox potential are comprised in the range of 0.3–0.6 Volt NHE. Typically trivalent iron and bivalent copper may be added to the acid, however the invention is not intended to be limited thereto. Trivalent iron is particularly preferred as, it does not cause poisoning of the gas diffusion cathode, where it may arrive at, after migrating through the membrane. The best preferred concentrations for trivalent iron fall in the range of 100–10,000 ppm, and preferably in the range of 1,000–3,000 ppm.
- Use of gas diffusion cathodes fed with air, oxygen-enriched air or pure oxygen.
- Maintaining the maximum concentration of hydrochloric acid inside the electrolyzer at 20%.
- Limiting the temperature to about 60° C.
- Optional further addition of an alkali salt, preferably an alkali chloride, for example in the simplest case sodium chloride, to the aqueous hydrochloric acid solution.

The reasons for said modifications may be explained as follows:

- addition of trivalent iron or other oxidizing compound with a similar redox potential. Titanium is maintained in passive conditions, that is resistant to corrosion, due to the formation of a protective oxide film induced by the oxidizing compound, even in the absence of electric current or chlorine. This is the typical situation of the start-up and shut-down of the cell due to emergency reasons for the sudden interruption of electric current.

During operation, the electric current and the chlorine dissolved in the hydrochloric acid solution add their effect to that of the oxidizing compound, reinforcing the passivating action. The oxidizing compound is capable of forming the protective oxide, mainly when its redox potential is sufficiently high, at least 0 Volt NHE (Normal Hydrogen Electrode), preferably 0.3–0.6 Volt NHE, and when its concentration exceeds certain limit values. In the specific case of trivalent iron this minimum concentration is 100 ppm. However, this concentration is preferably maintained in the range of 1,000–3,000 ppm, in order to attain a higher reliability and also an efficient protection of the cathode compartment, as discussed in the following description. The necessary concentration of the oxidizing compound in the hydrochloric solution circulating in the anode compartments of the cells may be controlled by measuring the redox potential values or by amperometric measurement as is well known in the electroanalytic technique, through easily available probes and commercial instruments.

Use of gas diffusion cathodes. With this type of cathodes the cathodic reaction takes place between oxygen and protons migrating from the anode compartment through the membrane with the production of water. As already said, this water, which as a liquid phase wets the walls of the cathode compartments, is strongly acid due to the migration of hydrochloric acid through the membrane. This acidity may be comprised between 4 and 7% depending on the operating conditions. Therefore, also the cathode compartments are subjected to a strong aggressive action, even if lower than that typical of the anode compartments. The acidic liquid phase contains also the oxidizing compound which is added to the hydrochloric acid solutions circulating inside the anode compartments. The oxidizing compound, in particular if in the form of a cation, as is the case for trivalent iron, migrates through the membrane due to the electric field and accumulates in the reaction water inside the pores of the gas diffusion cathode. The concentration of the oxidizing compound in the acidic reaction water depends, at the same operating conditions, on the concentration of the oxidizing compound in the hydrochloric acid solution circulating in the anode compartment. If the latter is maintained, as afore mentioned, at sufficiently high values, for example in the case of trivalent iron in the range of 1,000–3,000 ppm, then also the concentration in the cathodic reaction water reaches values sufficient to keep titanium safely passivated even when the acidity reaches values of 4–7%. On the other hand, the use of gas diffusion cathodes eliminates the cathodic reaction of hydrogen evolution which would be extremely risky with titanium, both for the possibility of embrittlement as well as for the possibility of destruction of the protective corrosion-resistant oxide.

Once the conditions necessary to the formation of the titanium protective oxide are obtained by a suitable concentration of the oxidizing compound both in the hydrochloric acid solution circulating inside the anode compartments, and in the acidic water of the cathodic compartment, it is necessary to avoid that other operating conditions may cause its dissolution. It has been found that suitably safe conditions are obtained when the operating temperature does not exceed 60° C. and the maximum concentration of hydrochloric acid in the solution circulating inside the anode compartments is 20% by weight. It has also been observed that the circulation of the hydrochloric acid solution in the anode compartments efficiently removes the heat generated both by the Joule effect in the solution and in the membrane and by the electrochemical reactions. It has been possible to maintain the temperature within the prefixed limit of 60° C. also with a current density of 3,000–4,000 Ampere/$m^2$, with moderate flow rate of the hydrochloric acid solutions, for example of 100 l/h/$m^2$ of membrane.

Addition of an alkali salt, in particular sodium chloride, to the hydrochloric acid solution circulating inside the anode compartments. This addition is made in order to combine the electric current transport effected by means of the protons with that effected by the alkali cations, in particular sodium cations. This combined electric current transport, if suitably balanced, neutralizes most of the acidity present in the cathodic reaction water in the cathode compartments. The acidity may be thus reduced to values in the range of about 0.1–1%, with respect to 4–7% characterizing the operating conditions without the addition of alkali salts. In the specific case of sodium chloride, it has been noted that additions of 20–50 g/l to 20% hydrochloric acid solutions substantially decrease the acidity of the cathodic reaction water with a definite additional stabilizing effect on the titanium. These mild conditions also decrease the leaching rate of certain catalysts which may be incorporated in the gas diffusion cathodes.

During testing with electrochemical cells as illustrated in FIG. 1, it has been demonstrated that the above mentioned conditions, that is addition of an oxidizing compound, control of the temperature, maintaining a maximum concentration for the hydrochloric acid circulating and use of gas diffusion electrodes, allow the use of titanium for the construction of the anode and cathode compartments with a sufficient long-term reliability as regards corrosion. The only weak points have occasionally been found in the crevice areas, that is where titanium is not free to contact the liquid phases containing the oxidizing compound. A typical example is the peripheral flanges of the anodic and cathodic compartments, in correspondence of the gasketing area. The problem is overcome by applying to the crevice area, and mainly on the peripheral flanges and various nozzles, a coating comprising metals of the platinum group as such or as oxides or as a mixture thereof and optionally further mixed with stabilizing oxides, such as titanium, niobium, zirconium and tantalum oxides. A typical example is a mixed oxide of ruthenium and titanium in equimolar ratio.

A further even more reliable solution comprises using, instead of pure titanium, titanium alloys. Particularly interesting from the point of view of cost and availability is the titanium-palladium 0.2% alloy. This alloy is particularly resistant in the crevice areas, as known in the art, and is completely immune from corrosion in the areas of free contact with the acidic solutions containing oxidizing compounds, as previously illustrated.

EXAMPLE

Figure 2:
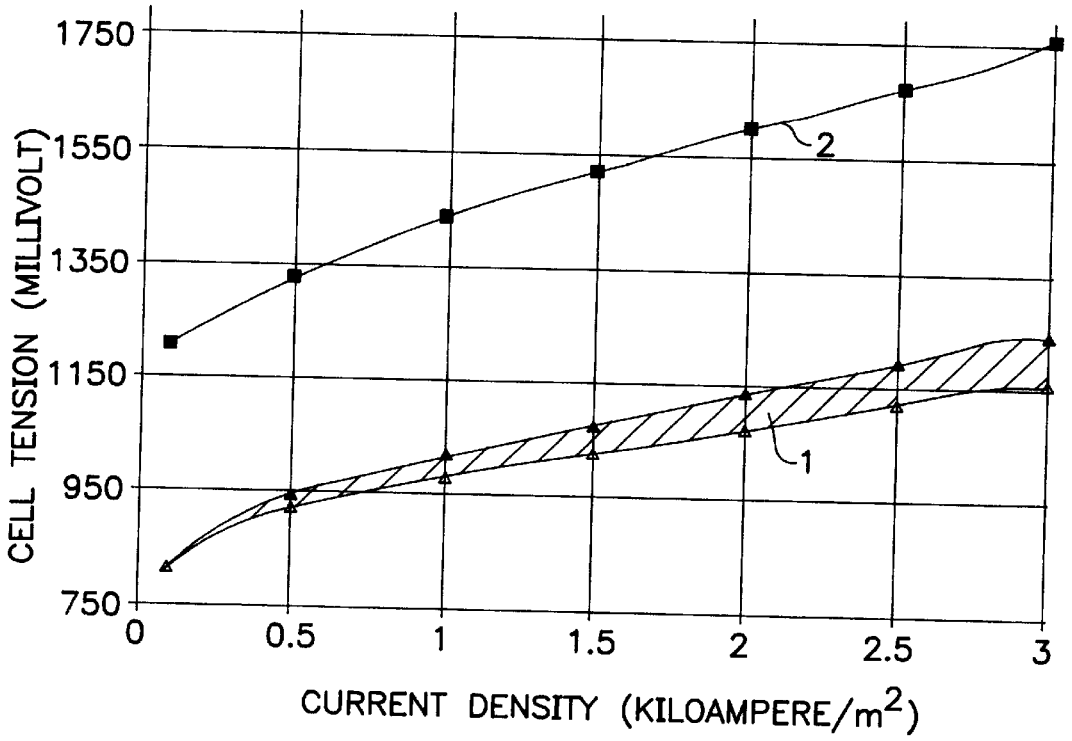
FIG. 2 shows the relationship between cell voltage and current density.

As regards the performance of the electrochemical cells described above, FIG. 2 shows the relationship between the cell voltage and the current density obtained both according to the teachings of the present invention (1) and those of the prior art (2). The anodic and cathodic compartments (reference numerals 2 and 3, 7 and 14 in FIG. 1) made of titanium-palladium 0.2% alloy provided with peripheral gaskets made of EPDM elastomer (reference numerals 15 and 16 in FIG. 1). The anode compartment was provided with an anode made of an expanded titanium-palladium 0.2% alloy sheet forming an unflattened mesh 1.5 mm thick with rhomboidal apertures having diagonals of 5 e 10 mm respectively, provided with an electrocatalytic coating made of a mixed oxide of ruthenium, iridium and titanium (4 in FIG. 1). The cathode compartment was provided with a coarse 0.2% titanium-palladium mesh 1.5 mm thick with rhomboidal apertures having diagonals of 5 and 10 mm respectively, with a thin mesh (reference numerals 9, 10, 11 in FIG. 1) of 0.2% titanium-palladium (thickness 0.5 mm, rhomboidal apertures with diagonals of 2 and 4 mm respectively) spot welded thereto. The thin mesh was provided with an electroconductive coating made of platinum-iridium alloy. The double mesh structure supported a gas diffusion cathode consisting of an ELAT electrode commercialized by E-TEK-USA (30% platinum on Vulcan XC-72 active carbon, for a total of 20 g/m$^2$ of noble metal), provided with a film of perfluorinated ionomeric material on the side opposite to that in contact with the double mesh structure (8 in FIG. 1). The two compartments were separated by a Nafion®117 membrane, supplied by Du Pont-USA (1 in FIG. 1). The anode was fed with an aqueous solution of 20% hydrochloric acid and the cathode compartment was fed with pure oxygen at slightly higher than atmospheric pressure with a flow rate corresponding to a stoichiometric excess of 20%. A pressure differential of 0.7 bar was maintained between the two compartments. The temperature was kept at 55° C. The hydrochloric acid was added with ferric chloride in order to reach a trivalent iron concentration of 3500 ppm. The liquid withdrawn from the bottom of the cathode compartment was made of an aqueous solution of 6% hydrochloric acid containing about 700 ppm of trivalent iron.

The operation of the cell lasted 350 hours with various intermediate shut-downs and prolonged inactivity periods in the presence of stagnant acid. No performance decay nor corrosion, even in the flanged areas under the peripheral gasketing, were detected. A further check was made analyzing the outlet liquids, without detecting any appreciable trace of titanium.

I claim:

1. Process for the electrolysis of aqueous solutions of hydrochloric acid for producing chlorine, carried out in electrolyzers consisting of at least one electrochemical cell comprising a cathode compartment and an anode compartment separated by a corrosion-resistant, cationic ion exchange membrane, the cathode and anode compartments being equipped with a gas diffusion cathode and an anode made of an inert substrate provided with an electrocatalytic coating for chlorine evolution, at least the gas diffusion cathode and the membrane being in intimate contact with each other, the cathode compartment being further provided with an inlet for feeding an oxygen-containing gas and an outlet for the discharge of the reaction water, the anode compartment comprising an inlet for the aqueous solution of hydrochloric acid to be electrolyzed and outlets for the removal of the exhausted hydrochloric acid solution and of the produced chlorine, characterized in that the process is carried out in a cell wherein the anode and cathode compartments are made of the same construction material, which is selected from the group consisting of titanium and titanium alloys and by adding to the aqueous solution of hydrochloric acid to be electrolyzed an oxidizing compound having a redox potential at least equal 0 Volt NHE and that must be alsways kept in the oxidized condition by chlorine and must be significantly reduced when it comes in contact with the cathode.

2. The process of claim 1 characterized in that the redox potential is comprised between 0.3 and 0.6 Volt NHE.

3. The process of claim 1 characterized in that said oxidizing compound is trivalent iron.

4. The process of claim 3 characterized in that the concentration of trivalent iron is maintained in the range of 100–10,000 ppm.

5. The process of claim 4 characterized in that said concentration is maintained in the range of about 1,000 to 3,000 ppm.

6. The process of claims 4 characterized in that the concentration is monitored by means of electrochemical probes or amperometric measurement.

7. The process of claim 1 characterized in that the concentration of the aqueous solution of hydrochloric acid to be electrolyzed has a maximum value of 20% by weight and the temperature of the aqueous solution of exhausted hydrochloric acid does not exceed 60° C.

8. The process of claim 7 characterized in that the temperature of the aqueous solution of exhausted hydrochloric acid is kept under control by adjusting the flow rate of the aqueous solution of hydrochloric acid to be electrolyzed.

9. The process of claim 8 characterized in that the flow rate has a value of 100 liter/hour/m$^2$ of membrane, with a current density of 3,000–4,000 Ampere/m$^2$ of membrane.

10. The process of claim 1 characterized in that the aqueous solution of hydrochloric acid to be electrolyzed further comprises an alkali salt.

11. The process of claim 10 characterized in that said alkali salt is sodium chloride and its concentration is comprised in the range of 20–50 grams/liter.

12. The process of claim 1 characterized in that the titanium or titanium alloy used as construction material for the anode and cathode compartments is provided with a protective electrocatalytic coating in the crevice areas of both compartments.

13. The process of claim 12 characterized in that said protective electrocatalytic coating is made of metals of the platinum group, their oxides, used as such or as a mixture thereof with the optional further addition of stabilizing oxides selected from the group of titanium, niobium, zirconium, tantalum oxides.

14. The process of claim 13 characterized in that said protective electrocatalytic coating is made of mixed oxides of ruthenium and titanium in an equimolar ratio.

15. The process of claim 1 characterized in that said construction material is a 0.2% by weight titanium-palladium alloy.

16. The process of claim 1 characterized in that the surface of the gas diffusion cathode in intimate contact with the ion exchange membrane is provided with a film of a ionomeric corrosion-resistant material compatible with the material forming the membrane.

17. The process of claim 1 characterized in that said intimate contact between the gas diffusion cathode and the ion exchange membrane is obtained before installation in said electrolyzer by adhesion under heat and pressure.

18. The process of claim 1 characterized in that the anode compartment is subjected to a higher pressure than the cathode compartment.

19. The process of claim 18 characterized in that the pressure differential between the anode and the cathode compartments is maintained in the range of 0.1–1.0 bar.

20. The process of claim 18 characterized in that said gas diffusion cathode and ion exchange membrane are supported by a rigid, porous structure having a multiplicity of contact points with the gas diffusion cathode surface opposite to that in intimate contact with the membrane, said structure being positioned in the cathode compartment.

21. The process of claim 20 characterized in that said structure is made of a rigid coarse expanded metal sheet or mesh and a thin expanded metal sheet or mesh, welded to each other, said coarse and fine expanded metal sheet or mesh being made of titanium or titanium alloy, said thin expanded metal sheet or mesh being provided with a corrosion resistant electroconductive coating.

* * * * *